US007397923B2

(12) United States Patent
Konagai

(10) Patent No.: US 7,397,923 B2
(45) Date of Patent: Jul. 8, 2008

(54) ARRAY SPEAKER SYSTEM

(75) Inventor: Yusuke Konagai, Hamamatsu (JP)

(73) Assignee: Yamaha Corporation (JP)

( * ) Notice: Subject to any disclaimer, the term of this patent is extended or adjusted under 35 U.S.C. 154(b) by 307 days.

(21) Appl. No.: 10/558,945

(22) PCT Filed: Jun. 1, 2004

(86) PCT No.: PCT/JP2004/007917

§ 371 (c)(1),
(2), (4) Date: Nov. 30, 2005

(87) PCT Pub. No.: WO2004/107812

PCT Pub. Date: Dec. 9, 2004

(65) Prior Publication Data

US 2007/0030976 A1 Feb. 8, 2007

(30) Foreign Application Priority Data

Jun. 2, 2003 (JP) ..... 2003-156767

(51) Int. Cl.
*H04R 5/00* (2006.01)

(52) U.S. Cl. ..... 381/17; 381/61; 381/310

(58) Field of Classification Search ..... 381/1, 381/17–19, 300, 310, 61–62, 303, 307
See application file for complete search history.

(56) References Cited

U.S. PATENT DOCUMENTS 5,146,507 A 9/1992 Satoh et al.
5,233,664 A 8/1993 Yanagawa et al.

(Continued)

FOREIGN PATENT DOCUMENTS

JP 63-009300 A 1/1988

(Continued)

OTHER PUBLICATIONS

Relevant portion of International Search Report of corresponding PCT Application PCT/JP2004/007917.

(Continued)

*Primary Examiner*—Vivian Chin
*Assistant Examiner*—Disler Paul
(74) *Attorney, Agent, or Firm*—Rossi, Kimms & McDowell, LLP

(57) ABSTRACT

An array speaker system, in which a plurality of speaker units are arranged in an array and are supplied with signals having prescribed time differences so as to perform directivity control on audio signal beams emitted therefrom, includes a delay memory (e.g., a shift register) having plural delay taps for outputting an input signal thereof with different delay times, which are set in units of the sampling period, and an interpolation processing means for performing interpolation processing on the output of the delay memory. A control means calculates distances between a focal point of audio signal beams and the speaker units so as to produce delay times, and it also sets interpolation coefficients with respect to the speaker units respectively. The interpolation processing means performs linear interpolation on the outputs of the delay memory. Alternatively, an FIR low-pass filter is formed using the delay memory and interpolation processing means, thus performing delay and interpolation processing. Delayed and interpolated signals are supplied to the speaker units, thus performing directivity control on audio signal beams with high precision.

3 Claims, 7 Drawing Sheets

U.S. PATENT DOCUMENTS

| | | | | |
|---|---|---|---|---|
| 5,581,618 | A * | 12/1996 | Satoshi et al. | 381/17 |
| 5,789,689 | A | 8/1998 | Doidic et al. | |
| 5,809,150 | A | 9/1998 | Eberbach | |
| 5,974,152 | A * | 10/1999 | Fujinami | 381/1 |
| 6,332,026 | B1 * | 12/2001 | Kuusama et al. | 381/17 |
| 6,546,105 | B1 * | 4/2003 | Katayama et al. | 381/17 |
| 6,754,352 | B2 | 6/2004 | Kanai et al. | |
| 7,003,124 | B1 | 2/2006 | Thiel | |
| 7,027,600 | B1 * | 4/2006 | Kaji et al. | 381/17 |
| 7,116,788 | B1 * | 10/2006 | Chen et al. | 381/17 |

FOREIGN PATENT DOCUMENTS

| | | | |
|---|---|---|---|
| JP | 1-25480 | B2 | 5/1989 |
| JP | 3-159500 | A | 7/1991 |
| JP | 4-127700 | A | 4/1992 |
| JP | 5-103391 | A | 4/1993 |
| JP | 5-317310 | A | 12/1993 |
| JP | 6-205496 | A | 7/1994 |
| JP | 9-233591 | A | 9/1997 |
| JP | 10-304500 | A | 11/1998 |
| JP | 11-027604 | A | 1/1999 |
| JP | 2003-510924 | A | 3/2003 |
| WO | WO 01/23104 | A2 | 4/2001 |

OTHER PUBLICATIONS

Related co-pending U.S. Appl. No. 10/558,947; Yusuke Konagai; "Array Speaker System", filing date Nov. 30, 2005; Spec. pp. 1-18; Figs. 1-11.

From related co-pending U.S. Appl. No. 10/558,947: Relevant portion of International Search Report of corresponding PCT Application PCT/JP2004/008008.

Related co-pending U.S. Appl. 10/558,542; Akira Usul; "Array Speaker System"; filing date Nov. 29, 2005; Spec. pp. 1-20; Figs. 1-12.

From related co-pending U.S. Appl. 10/558,542: Relevant portion of International Search Report of corresponding PCT Application PCT/JP2004/007911.

* cited by examiner

DELAY DIFFERENCE=
0.0154m÷340m/s=45 μs

DELAY DIFFERENCE=
0.0003m÷340m/s=0.9 μ

ARRAY SPEAKER SYSTEM

TECHNICAL FIELD

This invention relates to array speaker systems in which a plurality of speaker units are arranged in an array.

BACKGROUND ART

Conventionally, technologies for controlling audio signal beams (i.e., sound waves converted into beams having directivities) by use of array speakers, in which a plurality of speaker units are regularly arranged so as to produce sounds, are known. For example, Japanese Unexamined Patent Application Publication No. H03-159500 and Japanese Unexamined Patent Application Publication No. S63-9300 disclose technologies regarding array speaker systems.

A control method for sound directivity in an array speaker will be described with reference to FIG. 7.

In FIG. 7, reference numerals sp-1 to sp-n designate speaker units that are linearly arranged with prescribed distances therebetween. In the case of generation of an audio signal beam emitted towards a focal point X, a circle Y whose radius matches a distance L from the focal point X is drawn. Delay times (=Li/speed of sound (340 m/s)) are calculated corresponding to distances Li between the speaker units sp-i (where i=1, . . . , n) and the intersecting points, at which the circle Y intersects line segments interconnecting the focal point X and the speaker units sp-1 to sp-n respectively, and the delay times are applied to input signals of the speaker units sp-i. Thus, it is possible to control the sound directivity of the array speaker in such a way that audio signal beams respectively emitted from the plural speaker units sp-1 to sp-n reach the focal point X at the same time.

As described above, prescribed delay times are applied to audio signal beams output from the speaker units so as to control the sound directivity of an array speaker in such a way that plural audio signal beams reach a prescribed point (or a focal point) desirably set in a three-dimensional space at the same time, whereby it is possible to obtain an effect as if prescribed sound was emitted in the direction towards the focal point.

According to an application of the aforementioned sound directivity control technology, a plurality of audio signal beams are reflected on a desired wall surface of a room so as to produce a virtual sound source thereon, whereby it is possible to realize a multi-channel surround effect.

FIG. 8 is an illustration showing an example of an application of the aforementioned sound directivity control technology, wherein reference numeral 81 designates a listening room; reference numeral 82 designates a video device such as a television set; reference numeral 83 designates an array speaker; and reference numeral 84 designates a listener. This performs 5.1 channel reproduction, wherein with respect to center channel (C) signals, an audio signal beam is emitted at a front side of the array speaker 83; with respect to main left channel (L) signals, an audio signal beam is controlled to strike a left-side wall surface of the listening room 81 so as to realize a virtual left channel 85; and with respect to main right channel (R) signals, an audio signal beam is controlled to strike a right-side wall surface of the listening room 81 so as to realize a virtual right channel 86. With respect to surround left channel (SL) signals, an audio signal beam is controlled such that it is reflected on the left-side wall surface and then strikes a rear-side wall surface, thus realizing a virtual surround left channel 87. With respect to surround right channel (SR) signals, an audio signal beam is controlled such that it is reflected on the right-side wall surface and then strikes the rear-side wall surface, thus realizing a virtual surround right channel 88.

As described above, by use of the array speaker 83, with respect to the L-channel signals, R-channel signals, SL-channel signals, and SR-channel signals, the corresponding audio signal beams are controlled to strike the prescribed wall surfaces of the listening room 81 so as to realize the virtual channels 85 to 88, whereby it is possible to perform three-dimensional sound control in such a way that the corresponding sounds can be heard by way of the virtual channels.

There also exist applied technologies in which different sound directivities are allocated to different contents so as to realize hearing of different contents in the left side and right side of a room respectively. This is disclosed in Japanese Unexamined Patent Application Publication No. H11-27604, for example.

As described above, it is possible to realize multi-channel reproduction and simultaneous reproduction of different contents by controlling audio signal beams in array speakers.

However, when audio signal beams are controlled in an array speaker, there exist problems due to differences of audio wavelengths. That is, in order to control signals of low-frequency ranges, it is necessary to adequately increase the overall width of an array speaker; but in order to control signals of high-frequency ranges, it is necessary to adequately decrease the distance between adjacent speaker units in the array speaker. For example, in order to control an audio signal beam by controlling side lobes of signals at the frequency of 10 kHz, which belongs to an essential audio frequency band, it may be ideal that the distance between adjacent speaker units be set to 3.4 cm (=speed of sound, 340 m/sec÷10 kHz), which matches the wavelength thereof or is lower. In this case, differences of delay times between adjacent speaker units are reduced to be very small.

The aforementioned phenomenon will be described in detail with reference to FIGS. 9A and 9B. These drawings show differences of delay times between adjacent speaker units (designated by reference symbols spa and spb) in an array speaker in which adjacent speaker units are each arrayed with a distance of 3.4 cm therebetween when an audio signal beam is controlled to be directed towards a focal point X, which is set 2 m distant from the front surface of the array speaker. In the case of FIG. 9A, the focal point X is set on the basis of a reference position that is 1 m distant from the speaker unit spb. In the case of FIG. 9B, the focal point X is set on the basis of a reference position corresponding to the position of the speaker unit spb.

Specifically, in the case of FIG. 9A, a distance of 2.2361 m lies between the speaker unit spb and the focal point X; and a distance of 2.2515 m lies between the speaker unit spa, which is adjacent to the speaker unit spb, and the focal point X, wherein a difference of delay times between the speaker units spb and spa is calculated as (2.2515 m−2.2316 m)÷340 m/sec=45 μs. When a delay time ta is applied to an input signal of the speaker unit spa, a delay time applied to an input signal of the speaker unit spb is represented as (ta+45 μm). In the case of FIG. 9B, a distance of 2 m lies between the speaker unit spb and the focal point X; and a distance of 2.0003 m lies between the speaker unit spa and the focal point X, wherein a difference of delay times between the speaker units spb and spa is calculated as 0.0003 m÷340 m/sec=0.9 μs. In this case, a delay time of (ta+0.9 μm) is applied to an input signal of the speaker unit spb.

As described above, a difference of delay times between adjacent speaker units may vary in response to the position of the focal point X; normally, however, it ranges from several tens of micro-seconds to one micro-second or less; that is, it is a very small time difference.

FIG. 10 shows a basic constitution of a delay control circuit (or an audio signal beam control circuit) for an array speaker, in which delay times are respectively applied to signals supplied to speaker units. This shows the circuitry that handles a one-channel signal, i.e., an audio signal beam only. The circuitry handling plural channels (or plural audio signal beams) can be realized by way of the addition for adding together delayed channel signals prior to D/A converters; hence, the circuit of FIG. 10 can be easily expanded.

In FIG. 10, reference numeral 91 designates an A/D converter; reference numeral 92 designates a delay memory having plural taps; reference numerals 93 designate multipliers arranged in connection with speaker units; reference numerals 94 designate D/A converters arranged in connection with speaker units; reference numerals 95 designate speaker units forming an array speaker; and reference numeral 96 designates a control means (i.e., a microcomputer) for setting up delay times, i.e., for making setup such that one of the taps of the delay memory 92 is to be connected to the multiplier 93 arranged in connection with a desired speaker unit 95.

In the delay control circuit having the aforementioned constitution, an analog input signal is converted into a digital signal in the A/D converter 91 and is then supplied to the delay memory 92. In contrast, a digital input signal is directly supplied to the delay memory 92 without the intervention of the A/D converter 91. The delay memory 92 is a shift register that is constituted by connecting together delay elements in plural stages in series, wherein the input signal thereof (i.e., the digital signal) is delayed by delay times, which are integer times greater than the sampling frequency, and is then output from each of the taps. The microcomputer 96 calculates a delay time to be applied to a desired speaker unit in response to the position of the focal point X, to which an audio signal beam is to be directed; then, the output of the tap of the delay memory 92 designated by the calculated delay time is selectively connected with a multiplier 93 in connection with the desired speaker unit. A delay signal output from the selected tap of the delay memory 92 is supplied to the multiplier 93 in which window processing required for audio signal beam control is executed and in which a volume gain is applied thereto; thereafter, it is converted into an analog signal in the D/A converter 94 and is then supplied to the corresponding speaker unit 95, thus realizing emission of a prescribed audio signal beam.

As described above, delay times to be applied to speaker units respectively are selectively set up in the delay memory 92, in which the taps are positioned such that a delay value corresponding to the sampling frequency forms a minimal unit of delay time.

FIG. 11 shows a detailed constitution of the delay memory 92, wherein reference numerals 92-1 to 92-5 . . . designate delay elements that are connected in series to form a shift register.

For example, when a delay time D1 is applied to an input signal of each speaker unit in synchronization with a sampling period T1, the number of taps for realizing prescribed delay times can be calculated by D1/T1.

The microcomputer 96 shown in FIG. 10 calculates distances with regard to speaker units distant from the focal point X; then, it calculates delay times applied to input signals of the speaker units, wherein the delay times are realized as delay-tap numbers with respect to the speaker units. The delay-tap numbers are calculated by rounding off any fractions from D1/T1. Suppose that the calculation result of D1/T1 is represented as (a+b) where "a" represents an integer part, and "b" represents a decimal part; and the shift register has an input X(z) and an output Y(z), wherein the following relationships are established.

When $b>0.5$, $Y(z)=X(z)z^{-a}$.

When $b\geqq 0.5$, $Y(z)=X(z)z^{-(a+1)}$.

When the sampling frequency Fs is set to 200 kHz (i.e., sampling period T1=5 μs), and the applied delay time D1 is set to 17 μs, the calculation is performed as 17/5=3.4, wherein a=3 and b=4. In this case, b<0.5; hence, $Y(z)=X(z)\,z^{-3}$.

This designates the extraction of a signal to which a delay time of 15 μs is applied by a tap of the delay element 92-3 within the plural delay elements forming the shift register of the delay memory 92, whereby an error of 2 μs occurs in comparison with a desired delay time of 17 μs.

As described above, when the sampling frequency Fs is set to 200 kHz, the minimum unit of delay time that can be set up becomes equal to 5 μs. This makes it difficult to realize desired differences of delay times between speaker units.

In order to increase the resolution regarding the delay time, it is necessary to increase the sampling frequency Fs; however, in order to realize delay times using small minimum units, a relatively large capacity of memory is required, and it is necessary to provide D/A converters and an A/D converter having high-speed processing capabilities. In addition, it is necessary to perform high-speed digital processing. This brings difficulty in circuit designing; and there occur problems due to increase of electric power consumption and high manufacturing cost. Furthermore, in the case of digital signal processing such as digital filtering, a further large number of taps (i.e., the number of operational circuits) must be required in order to realize prescribed characteristics. For this reason, numerous disadvantages may occur when the sampling frequency is increased in order to increase the resolution regarding the delay time.

This invention is made in consideration of the aforementioned circumstances; hence, it is an object of the invention to provide an array speaker system that can control directivities of audio signal beams, realized by array speakers, with high precision.

SUMMARY OF THE INVENTION

An array speaker system has a plurality of speaker units arranged in an array. The speaker units are supplied with signals having prescribed time differences or delay times to control the directivities of audio signal beams emitted from the speaker units. This array speaker system includes a delay memory having a plurality of delay taps for delaying input audio signals in units of sampling periods and an interpolation processing means for outputting delay-imparted signals based on the input signals from the delay taps of the delay memory. The array speaker system further includes means for supplying the delay-imparted signals to the speaker units, and control means for calculating the delay time supplied to the signal output to each of the speaker units.

The interpolation processing means includes at least two multipliers for multiplying outputs of at least two of the delay taps from the delay memory by coefficients supplied from the control means and an adder for adding outputs of the at least two multipliers with respect to each speaker unit.

The control means divides the calculated delay time by the sampling period, and selects at least two delay taps from the delay memory on the basis of a position corresponding to a division result so that the outputs thereof are supplied to the at least two multipliers, to set the coefficients for performing linear interpolation or Lagrange's interpolation based on the division result with respect to the multipliers.

In one embodiment, the interpolation processing means includes two multipliers for multiplying outputs of the selected two delay taps from the delay memory, and the control means selects the two taps in the delay memory on the basis of a position corresponding to a division result so that the outputs thereof are supplied to the two multipliers, to set the coefficients for performing linear interpolation based on the division result with respect to the multipliers.

In another embodiment, the interpolation processing means includes at least three multipliers for multiplying outputs of the at least three delay taps selected from the delay memory, and the control means selects the at least three taps from the delay memory on the basis of a position corresponding to a division result so that the outputs thereof are supplied to the at least three multipliers, to set the coefficients for performing Lagrange's interpolation of two or more orders based on the division result with respect to the at least three multipliers.

The aforementioned interpolation processing means can be modified to execute linear interpolation; alternatively, it can be constituted in the form of an FIR low-pass filter comprising the aforementioned delay memory and the aforementioned interpolation processing means.

Thus, it is possible to perform directivity control on audio signal beams emitted from speaker units with high accuracy.

BEST MODE FOR CARRYING OUT THE INVENTION

This invention will be described in detail by way of embodiments with reference to the accompanied drawings.

Figure 1:
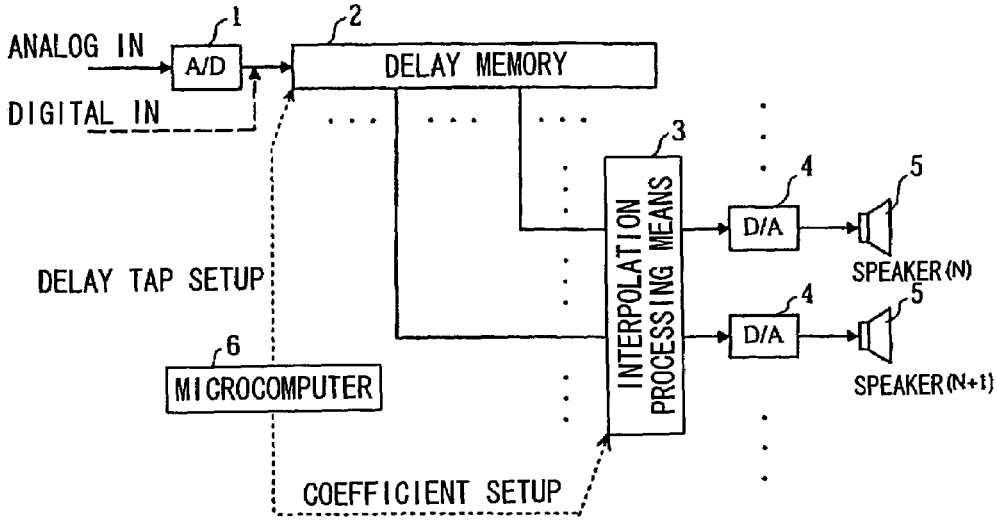
FIG. 1 is a block diagram showing the basic constitution of a delay control circuit adapted to an array speaker system in accordance with a first embodiment of this invention.

FIG. 1 is a block diagram showing the basic constitution of a delay control circuit (or an audio signal beam control circuit) adapted to an array speaker system in accordance with a first embodiment of this invention. This shows an example of the circuit constitution handling an audio output of a single channel (i.e., a single audio signal beam) only. It is possible to control a plurality of audio signal beams with respect to a plurality of channels by way of the addition for adding together a plurality of channel signals, to which prescribed delay times are respectively applied with respect to speaker units prior to A/D conversion. This can be easily realized by expanding the circuit constitution shown in FIG. 1.

Figure 10:
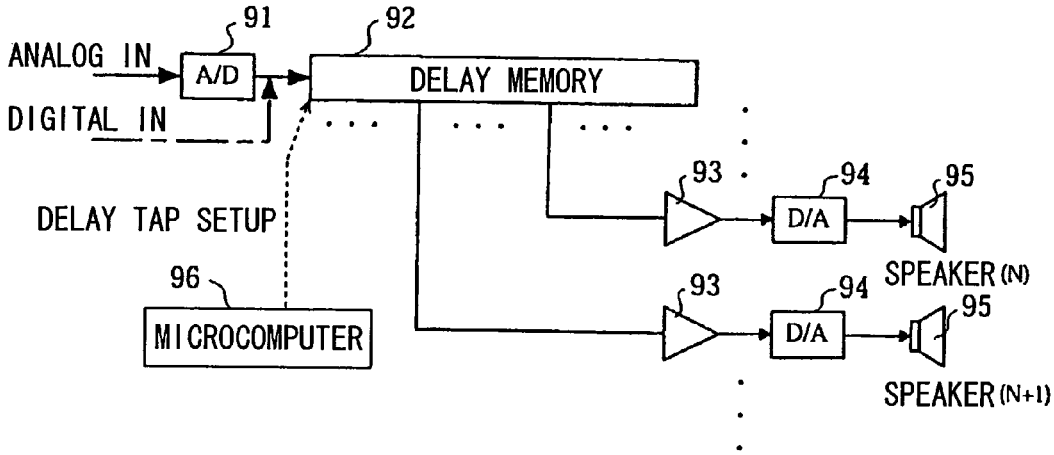
FIG. 10 is a block diagram showing a delay control circuit for controlling delay times applied to speaker units forming an array speaker.

In FIG. 1, reference numeral 1 designates an A/D converter that converts analog input signals regarding prescribed channels into digital signals; reference numeral 2 designates a delay memory that delays digital signals, which are supplied thereto via the A/D converter 1 or which are directly supplied thereto, in units of sampling frequency so as to output corresponding signals from taps; reference numeral 3 designates an interpolation processing means that performs interpolation processing on delay signals to be supplied to speaker units by use of the outputs of the taps of the delay memory 2; reference numerals 4 designate D/A converters that are arranged in connection with the plural speaker units forming an array speaker and that convert digital delay signals, which were subjected to interpolation processing in the interpolation processing means 3, into analog signals; and reference numerals 5 designate the speaker units that are arrayed with prescribed distances therebetween so as to form the array speaker. Furthermore, reference numeral 6 designates a control means (i.e., a microcomputer) that calculates distances between a focal point and the speaker units respectively in response to the position of the focal point, to which audio signal beams are directed, so as to produce signals supplied to the speaker units 5 based on the calculation results and that sets coefficients for use in the interpolation processing executed in the interpolation processing means 3 with respect to the speaker units. Incidentally, the foregoing delay control circuit shown in FIGS. 10 and 11 use the multipliers 93 in order to realize window processing and volume gains, which are required for controlling audio signal beams; however, the present embodiment omits illustration and description thereof to avoid complication.

As described above, in the array speaker system of the present embodiment, delay values applied to input signals of the speaker units are set up by way of the interpolation processing; hence, it is possible to realize directivity control of audio signal beams with high accuracy without increasing the sampling frequency.

Next, the constitution and operation of the interpolation processing means 3 will be described in detail.

Figure 2:
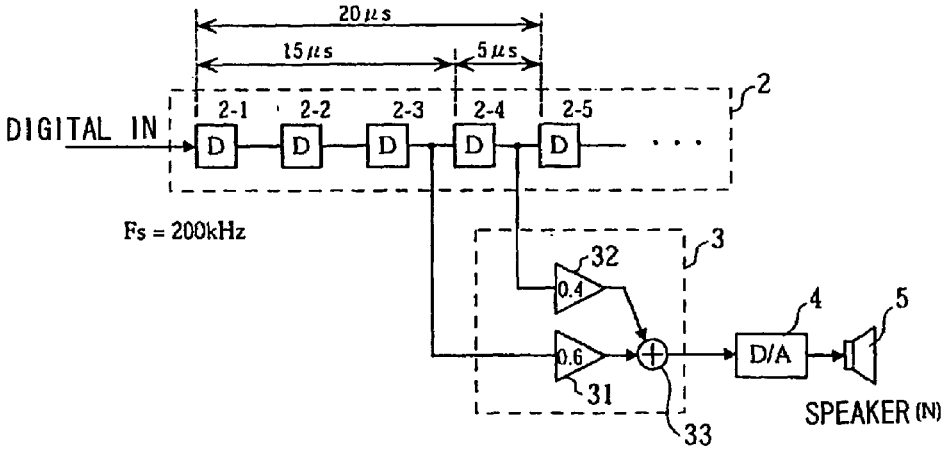
FIG. 2 is a block diagram showing the detailed constitution of an interpolation processing means that performs linear interpolation with respect to delay times applied to input signals of speaker units.

FIG. 2 shows a basic circuit constitution for executing linear interpolation in the interpolation processing means 3. This drawing shows the constitution of a delay control circuit with respect to a single speaker unit 5 (i.e., a speaker unit number "N" within the plural speaker units).

In FIG. 2, reference numerals 2-1 to 2-5 . . . designate delay elements for imparting delay times, each determined in response to a prescribed sampling period, to input data, wherein they are connected together to form the delay memory 2. The interpolation processing means 3 is constituted by multipliers 31 and 32, which multiply outputs of two taps matching a delay time applied to each speaker unit (i.e., outputs of two delay elements) by prescribed coefficients respectively, and an adder 33 that adds together the outputs of the multipliers 31 and 32 so as to output an addition result thereof to the D/A converter 4. That is, the present embodiment performs interpolation processing, which is formed by two multiplications and one addition, with respect to each speaker unit.

For example, with reference to an applied delay time D1 and a sampling period T1, it is possible to determine a desired delay-tap number by way of a calculation of D1/T1. With reference to a calculation result of D1/T1 that is represented as (a+b) consisting of an integer part "a" and a decimal part "b", the present embodiment determines coefficients b and (1−b) by way of linear interpolation so as to establish the following relationship.

$$Y(z)=(1-b)X(z)z^{-a}+bX(z)z^{-(a+1)}$$

Figure 11:
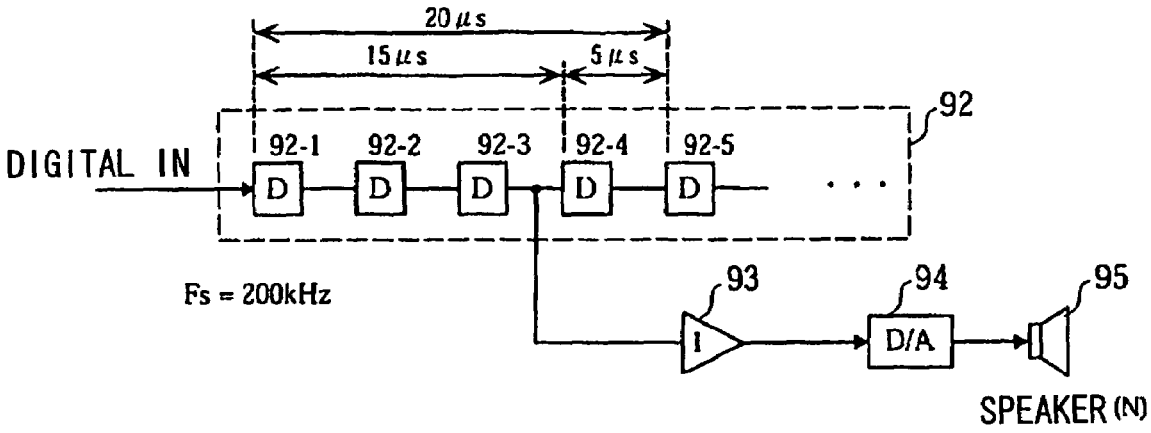
FIG. 11 is a block diagram showing the detailed constitution of a delay memory shown in FIG. 10.

Similarly to in the case of FIG. 11, when sampling period T1=5 μs, and applied delay time D1=17 μs, calculation is made as 17/5=3.4 where a=3 and b=0.4. Hence, as shown in FIG. 2, it is possible to establish the following relationship.

$$Y(z)=0.6X(z)z^{-3}+0.4X(z)z^{-4}$$

As described above, delay signals are extracted from two adjacent taps, which are selected to realize an applied delay value; then, an interpolation signal is produced by applying a prescribed weight to a decimal part thereof.

Except for calculation of coefficients in the microcomputer 6, the aforementioned interpolation processing can be realized by a simple combination of multiplication and addition. For this reason, the practical form of an array speaker requires the addition of plural channel signals and the multiplication of window coefficients as described above; therefore, it is unnecessary to add new constituent elements in order to realize the hardware of the present embodiment. As processing resources, the conventional technology requires one multiplication and addition with respect to one channel and one output speaker; however, the present embodiment requires two multiplications and addition.

When word lengths of coefficients of a processor are ignored, the aforementioned linear interpolation is advantageous in that any time precision (i.e., any resolution) can be set substantially without limits by way of the relatively simple processing.

However, the aforementioned equations clearly indicate that the linear interpolation functions as a low-pass filter (LPF). In addition, its frequency characteristics must be varied upon variations of the coefficients b and (1−b).

Figure 3:
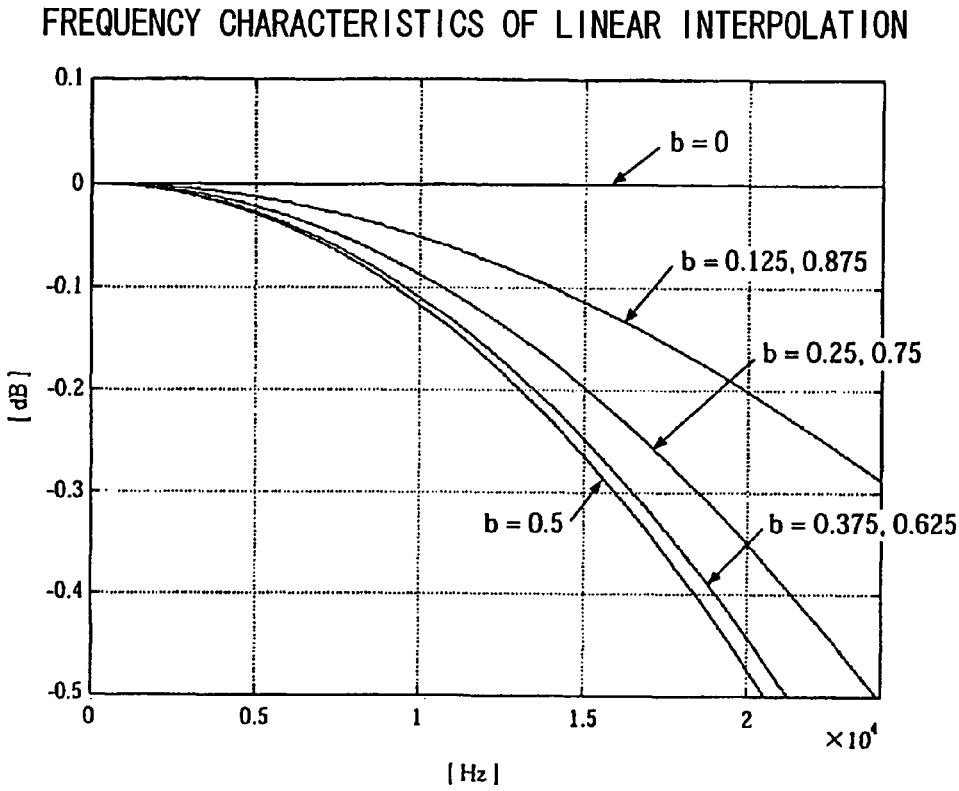
FIG. 3 is a graph showing frequency characteristics regarding execution of linear interpolation using different coefficients.

FIG. 3 is a graph showing examples of frequency characteristics in linear interpolation. Herein, the sampling frequency is set to 192 kHz. As shown in this graph, dispersions occur in frequency characteristics in response to the coefficient b; however, dispersions of approximately 0.5 dB or less occur with respect to a frequency difference of 20 kHz or so; and dispersions of approximately 0.1 dB or less occur with respect to a frequency difference of 10 kHz or so. These values certainly belong to practical ranges depending on types of content.

Figure 4:
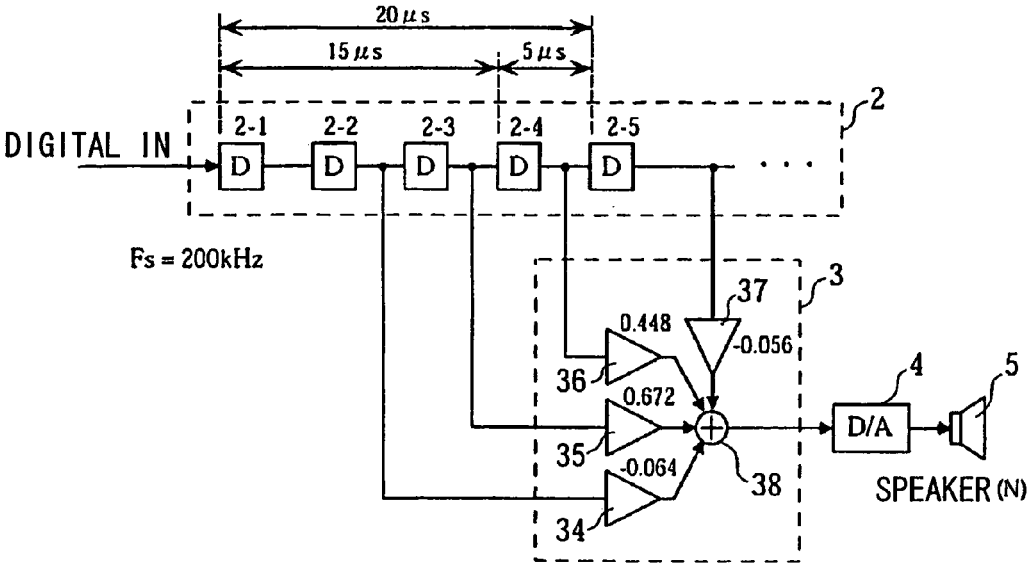
FIG. 4 is a block diagram showing the detailed constitution of an interpolation processing means using a LPF of an FIR type in a delay control circuit adapted to an array speaker system in accordance with a second embodiment of this invention.

When disadvantages occur due to variations of frequency characteristics in the aforementioned linear interpolation, it may be necessary to perform interpolation processing using an LPF of a low-order FIR (finite impulse response) type. FIG. 4 shows a detailed constitution of an interpolation processing means that is constituted using a LPF of a low-order FIR type in a delay control circuit (see FIG. 1) adapted to an array speaker system in accordance with a second embodiment of this invention.

In the second embodiment shown in FIG. 4, an FIR filter is formed to have the following characteristics.

$$Y(z)=a_0X(z)z^{-(a-n)}+\ldots+a_nX(z)z^{-a}+\ldots+a_{2n+1}X(z)z^{-(a+n+1)}$$

In addition, the microcomputer 6 provides filter coefficients $a_0, \ldots, a_n, \ldots, a_{2n+1}$ with regard to the decimal part b of the calculated value of D1/T1.

In the second embodiment shown in FIG. 4 in which a=3 and b=0.4, coefficients are calculated by way of third-order Lagrange's interpolation (where n=1) and are used to form an LPF using four taps, i.e., an LPF having the following characteristics.

$$Y(z)=-0.064X(z)z^{-2}+0.672X(z)z^{-3}+0.448X(z)z^{-4}-0.056X(z)z^{-5}$$

In FIG. 4, reference numerals 34, 35, 36, and 37 designate multipliers for multiplying the outputs of the corresponding taps of the delay memory 2 by prescribed coefficients; and reference numeral 38 designates an adder for adding together the outputs of the multipliers 34 to 37. That is, the interpolation processing of the present embodiment is realized by four multiplications and three additions. The present embodiment can be realized simply using multiplication and addition; hence, as processing resources, four multiplications and addition are required per one input channel and one output channel.

Filter coefficients are calculated in advance when designing a polyphase filter, wherein they are stored in the form of a table inside of the microcomputer 6. In FIG. 4, four coefficients are required per a single filter (i.e., per one coefficient b); hence, in order to realize 64-times resolution with respect to time, it is necessary to provide a table consisting of 256 (=64×4) words.

Figure 5:
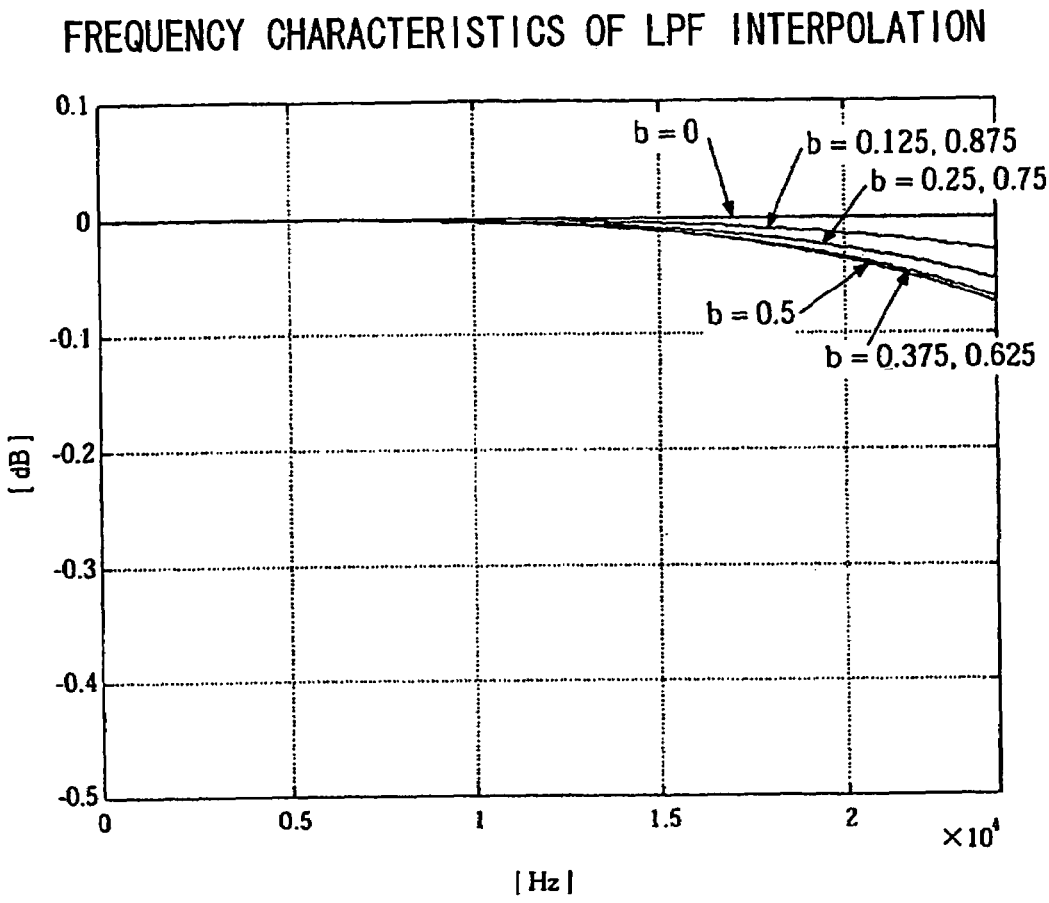
FIG. 5 is a graph showing frequency characteristics regarding execution of LPF interpolation using different coefficients.

FIG. 5 is a graph showing frequency characteristics in the second embodiment shown in FIG. 4. Herein, the sampling frequency is set to 192 kHz. As shown in FIG. 5, dispersions of 0.05 dB or less occur with respect to a frequency difference of 20 kHz; and dispersions of 0.01 dB or less occur with respect to a frequency difference of 10 kHz; hence, the present embodiment can be adequately embodied using a low-order FIR filter.

Incidentally, the interpolation processing of the present embodiment is not necessarily limited to third-order Lagrange's interpolation; hence, it is possible to use second-order or fourth-order Lagrange's interpolation. That is, the outputs of three taps are used in the second-order Lagrange's interpolation; and the outputs of five taps are used in the fourth-order Lagrange's interpolation.

FIGS. 6A to 6D show waveforms for explaining the aforementioned interpolation processing.

Figures 6A, 6B, 6C, 6D:
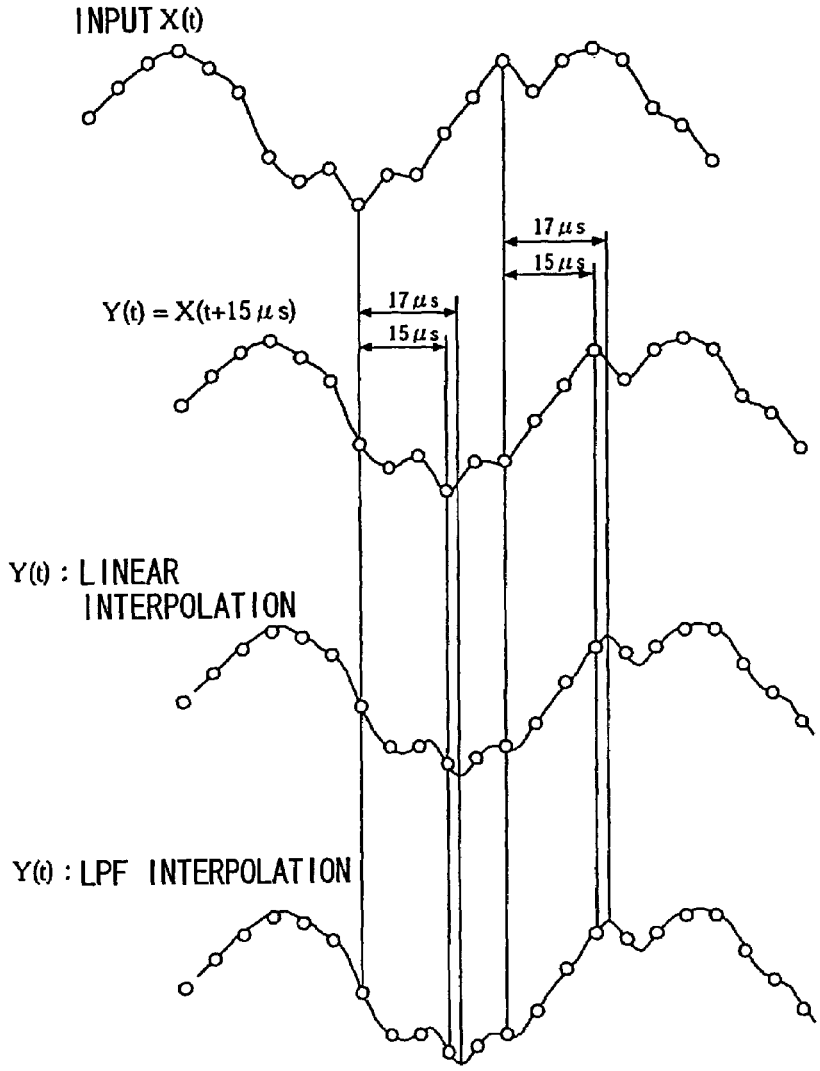
FIG. 6A shows a waveform of an input signal X(t)
FIG. 6B shows a waveform of an output signal Y(t)=X(t+15 μs)
FIG. 6C shows an output waveform subjected to linear interpolation.
FIG. 6D shows an output waveform subjected to LPF interpolation.
Figure 7:
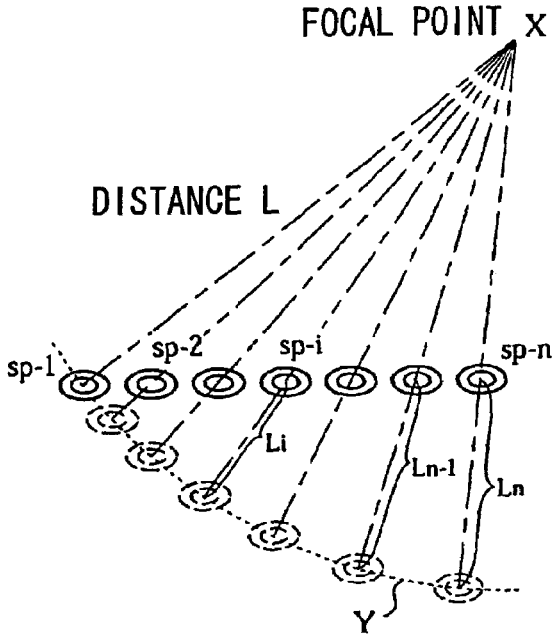
FIG. 7 is an illustration for explaining a control method for audio signal beams in an array speaker.
Figure 8:
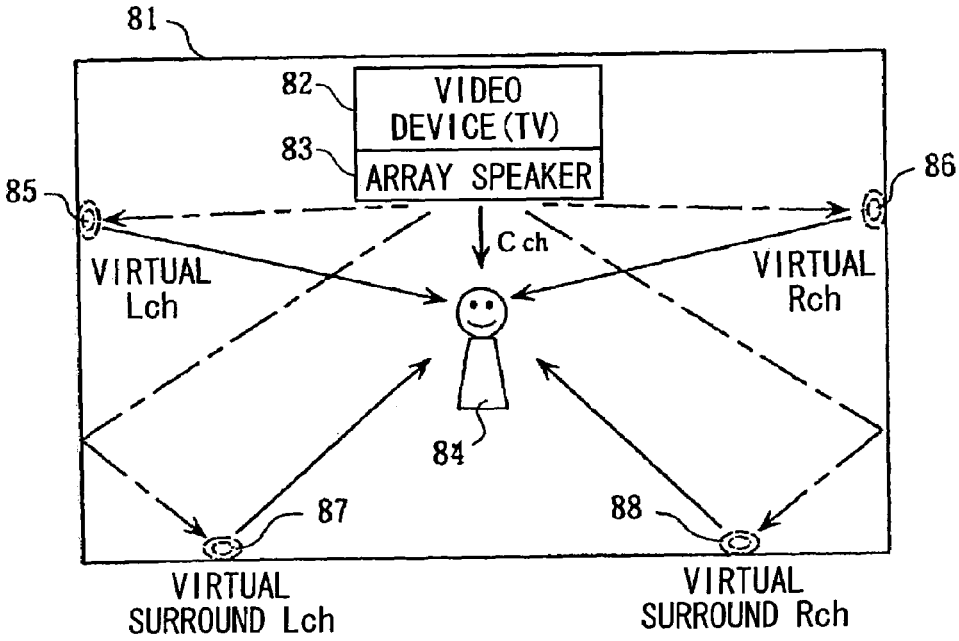
FIG. 8 is an illustration for explaining a multi-channel reproduction method using an array speaker.
Figure 9A:
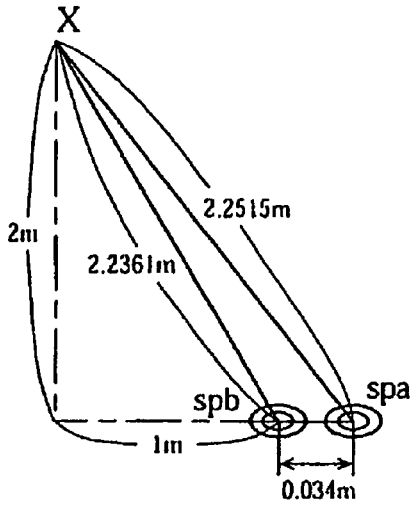
FIG. 9A is an illustration showing an example of a difference of delay times between adjacent speaker units.
Figure 9B:
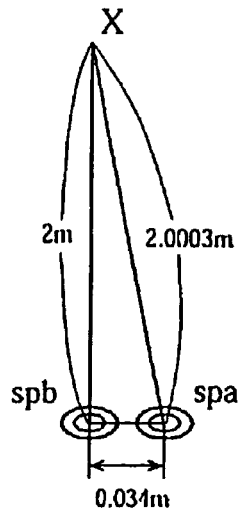
FIG. 9B is an illustration showing another example of a difference of delay times between adjacent speaker units.

That is, FIG. 6A shows a waveform with respect to an input signal X(t); FIG. 6B shows a waveform with respect to an output signal Y(t)=X(t+15 μs) shown in FIG. 11; FIG. 6C shows a waveform with respect to an output signal Y(t)=0.6X(t+15 μs)+0.4X(t+20 μs) in the linear interpolation shown in FIG. 2; and FIG. 6D shows a waveform with respect to an output signal Y(t)=−0.064X(t+10 μs)+0.672X(t+15 μs)+0.448X(t+20 μs)−0.056X(t+25 μs).

Due to the aforementioned interpolation processing, it is possible to produce ideal delay signals (e.g., a signal for delaying an input signal by 17 μs).

In the linear interpolation and low-order LPF interpolation, as shown in FIGS. 3 and 5, dispersions may occur in frequency characteristics depending on interpolated positions (i.e., positions determined by the coefficient b). For example, in the case of FIG. 3, dispersions of 0.1 dB occur with respect to a frequency difference of 10 kHz.

Array speakers have certain limits with regard to controllable upper-limit frequencies used therewith. That is, when pitches between speaker units each increase to be ½ the output wavelength or more, phases must be coordinated at a certain position outside of the position of a prescribed focal point; and this may cause the formation of two or more audio signal beams. In practice, the diameter of a speaker unit is set to 2 cm or so, whereby plural speaker units are arrayed in a zigzag manner so as to form a two-dimensional honeycomb structure, thus reducing effective length of pitch. In this case, however, it is difficult to reduce the pitch to be less than 2 cm. For this reason, the controllable upper-limit frequency of an array speaker must be 10 kHz or less.

As described above, the controllable upper-limit frequency for an array speaker must be limited to be lower than the upper-limit frequency in audio frequencies. Such an array speaker is not influenced by dispersion of frequency characteristics depending on interpolated positions and therefore has compatibility with linear interpolation and LPF interpolation.

In the aforementioned embodiments, the delay memory 2 is formed as a shift register in which plural delay elements are connected in series, although this is not a restriction. That is, it is required that the delay memory 2 provides delayed outputs in units of the sampling frequency. For example, it is possible to use a digital memory into which an input signal subjected to sampling is written and from which a delayed signal is read out after a lapse of a prescribed sampling period.

As described heretofore, this invention has a variety of effects and technical features, which will be described below.

(1) It is possible to set differences of delay times between speaker units forming an array speaker with very fine resolution. In addition, the existing resources of digital processing devices can be used for controlling audio signal beams in array speakers; hence, this invention can be realized without requiring the addition of new hardware.

(2) This invention does not necessarily increase the sampling frequency in order to improve resolution with regard to delay times; for this reason, this invention does not require large-capacity memory and does not require D/A converters or A/D converters realizing high-speed processing. That is, this invention does not require high-speed digital processing; hence, it is possible to prevent the consumption of electricity and cost from being increased.

Incidentally, this invention is not necessarily limited to the aforementioned embodiments; hence, modifications of the invention as defined in the appended claims can be embraced within the scope of the invention.

The invention claimed is:

1. An array speaker system in which a purality of speaker units arranged in an array are supplied with signals having prescribed time differences to control the directivity of audio signal beams emitted from the speaker units, said array speaker system comprising:

a delay memory having a plurality of delay taps for delaying input audio signals in units of sampling periods;

interpolation processing means for outputting delay-imparted signals based on the input signals from the delay taps of the delay memory;

means for supplying the delay-imparted signals from the interpolation processing means to the speaker units; and control means for calculating a delay time applied to a signal output to each of the speaker units, wherein the interpolation processing means includes two multipliers for multiplying outputs of two of the delay taps from the delay memory by coefficients supplied from the control means and an adder for adding outputs of the two multipliers with respect to each speaker unit, and wherein the control means divides the calculated delay time by the sampling period, and selects the two delay taps from the delay memory on the basis of a position corresponding to a division result so that outputs thereof are supplied to the two multipliers, to set the coefficients for performing linear interpolation based on the division result with respect to the multipliers.

2. An array speaker system according to claim 1, wherein an FIR low-pass filter is formed using the delay memory and the interpolation processing means.

3. An array speaker system in which a plurality of speaker units arranged in an array are supplied with signals having time differences to control the directivity of audio signal beams emitted from the speaker units, said array speaker system comprising:

a delay memory having a plurality of delay taps for delaying input audio signals in units of sampling periods;

interpolation processing means for outputting corresponding delay-imparted signals based on the input signals from the delay taps of the delay memory;

means for supplying the delay-imparted signals from the interpolation processing means to the speaker units; and control means for calculating a delay time supplied to a signal output to each of the speaker units, wherein the interpolation processing means includes at least three multipliers for multiplying outputs of at least three delay taps selected from the delay memory by coefficients supplied from the control means and an adder for adding outputs of the at least three multipliers with respect to each speaker unit, and wherein the control means divides the calculated delay time by the sampling period, and selects the at least three delay taps from the delay memory on the basis of a position corresponding to a division result so that outputs thereof are supplied to the at least three multipliers, to set the coefficients for performing Lagrange's interpolation of two or more orders based on the division result with respect to the at least three multipliers.

* * * * *